US005727679A

United States Patent [19]

Newarski

[11] Patent Number: 5,727,679

[45] Date of Patent: *Mar. 17, 1998

[54] SINGLE-USE DRY FOOD AND LIQUID CONTAINER

[76] Inventor: Emil M. Newarski, 180 Rte. 46 East, Lodi, N.J. 07644

[21] Appl. No.: 593,406

[22] Filed: Jan. 29, 1996

[*] Notice: The term of this patent shall not extend beyond the expiration date of Pat. No. 5,496,575.

Related U.S. Application Data

[63] Continuation-in-part of Ser. No. 341,747, Nov. 18, 1994, Pat. No. 5,496,575.

[51] Int. Cl.[6] ..... B65D 23/04

[52] U.S. Cl. ..... 206/222; 206/541; 220/501; 426/115; 426/120; 426/130

[58] Field of Search ..... 206/222, 541, 206/549, 219; 220/501, 23.8, 23.83; 426/112, 115, 120

[56] References Cited

U.S. PATENT DOCUMENTS

| | | | |
|---|---|---|---|
| 400,752 | 4/1889 | Crossman | 206/541 |
| 620,891 | 3/1899 | Curtis | 206/541 X |
| 2,011,996 | 8/1935 | Belk | 206/549 |
| 2,597,567 | 5/1952 | Como | 206/541 X |
| 2,885,104 | 5/1959 | Greenspan | 206/219 X |
| 3,442,435 | 5/1969 | Ludder et al. | 426/120 X |
| 4,986,433 | 1/1991 | Davis | 220/23.8 |
| 5,167,973 | 12/1992 | Synder | 426/115 |
| 5,209,348 | 5/1993 | Schafer, III | 206/222 |
| 5,241,835 | 9/1993 | Ascone | 220/501 X |
| 5,496,575 | 3/1996 | Newarski | 426/115 |
| 5,514,394 | 5/1996 | Lenahan | 426/120 |

FOREIGN PATENT DOCUMENTS

| | | | |
|---|---|---|---|
| 2218962 | 11/1989 | United Kingdom | 426/120 |
| 2265816 | 10/1993 | United Kingdom | 220/501 |

*Primary Examiner*—Bryon P. Gehman

*Attorney, Agent, or Firm*—O'Connor, Cavanagh; John D. Titus

[57] ABSTRACT

A single use cereal and milk or other dry food and beverage container comprises an integral package formed of a first container of plastic or paperboard laminate construction containing a supply of liquid in a hermetically sealed condition, a second container of plastic or plastic coated paperboard construction for holding a supply of cereal having a removable cover for maintaining the cereal in a sealed condition, and a user operable valve on the first container and disposed opposite an orifice in the second container. The user first opens the second container by breaking the stay fresh seal to access the cereal and the valve. A spoon is disposed within the second container for ready use after accessing the cereal and before opening the valve. In one embodiment, an end portion of the spoon is specifically formed to break the aseptic seal and open the valve. The container is shelf storable, product displayable and readily disposable after single use.

19 Claims, 8 Drawing Sheets

SINGLE-USE DRY FOOD AND LIQUID CONTAINER

CROSS-REFERENCE TO RELATED APPLICATION

This application is a continuation in part of patent application Ser. No. 08/341,747, filed Nov. 18, 1994 now U.S. Pat. No. 5,496,575.

BACKGROUND OF THE INVENTION

This invention relates to a new and improved single use container for storing a dry food product and a drink product which are mixed together immediately prior to consumption.

In the field related to aseptic drink containers, it is known to provide a container of paperboard or plastic film laminate construction, with an aperture formed in the top of the container exposing an area of foil or plastic which the user punctures with the end of a straw. Such packages are disclosed in, for example, U.S. Pat. No. 4,287,247, issued Sep. 1, 1981 to Reil et al, U.S. Pat. No. 5,303,838, issued Apr. 19, 1994 to Luch et al, and U.S. Pat. No. 4,789,066, issued Dec. 6, 1988 to Lisiecki.

In the field related to combination cereal and milk bowls, it is known to provide a cereal bowl with separate self-contained cereal and milk compartments, as disclosed in U.S. Pat. No. 5,209,348, issued May 11, 1993 to Schafer. The construction disclosed in Schafer is designed to be reusable, and necessarily must be refrigerated in storage prior to use, and then re-washed after use. It is also known to provide a kit comprising an aseptic field container (brick) of aseptically packaged milk and a serving of cereal packaged together in a compartmentalized tray, as disclosed in U.S. Pat. No. 5,167,973 issued Dec. 1, 1993 to Snyder. The kit disclosed in Snyder does not positively retain the milk brick, which may become dislodged after the kit is opened or while the user is attempting to puncture the milk brick.

The art lacks a single use, commercially practical, disposable, readily and reliably useable cereal and milk container. Accordingly, it is a principal object of the present invention to provide a single use combination cereal and milk package in which the aseptic milk container is an integral part of the cereal bowl. Another significant object of the invention is to provide a single use combination dry food and liquid container in which the liquid container is an integral part of the dry food container.

SUMMARY OF THE INVENTION

According to the present invention a single use ready-to eat cereal and milk, oatmeal and water, or other dry good and liquid container comprises a liquid container, preferably capable of aseptically storing a measured supply of milk or water, and a dry food container, capable of holding a single serving of ready-to-eat cereal, oatmeal, or other dry food. The liquid container and the dry food container share a common wall to form an integral package. The integral package is preferably covered with a tear-off or peel-off lid to hermetically seal the contents of the dry food container. The integral wall between the liquid and the dry food contains a valve to seal the liquid aseptically in the liquid container, which is accessible from the dry food container. In use, the user removes the peel-off lid to expose the contents of the dry food container and to gain access to the valve, which is then opened to allow the liquid to flow into the dry food container to mix with the contents thereof prior to consumption. The valve is constructed of a frangible membrane sized and constructed to resist rupturing unless pierced by direct manipulation, such with the end of a spoon, a piercing valve, pull-tab, or other device that directly cuts or tears the membrane to open the valve. By locating the valve in the dry food container, the valve is protected from premature, inadvertent opening.

In one embodiment, the valve is a formed of a frangible plastic or metal foil membrane forming part of the aseptic seal of the liquid container, and the dry food container is formed with an aperture disposed adjacent the valve so that the milk flows from the liquid container through the broken frangible membrane and the aperture into the second container.

In another embodiment, a plastic spoon is disposed within the second container. An end portion of the spoon is specially contoured to permit the user to readily break the frangible membrane.

In yet another embodiment, a separate opener is fixed to the inner surface of the dry food container juxtaposed the frangible membrane to permit the user to readily break the frangible membrane by pressing the opener.

The liquid and dry food containers are, in one embodiment, rectangular parallelepiped configuration, with a rectangular cover or box to hold the containers so as to provide an integral, shelf storable, stackable and displayable single use construction.

In another embodiment, the dry food container comprises a substantially bowl shaped container with the liquid container surrounding the dry food container so as to provide a more aesthetically pleasing bowl-shaped single use container.

BRIEF DESCRIPTION OF THE DRAWINGS

The above and other objects, aspects, features and attendant advantages of the present invention will become apparent from a consideration of the ensuing detailed description of presently preferred embodiments and methods thereof, taken in conjunction with the accompanying drawings, in which.

DESCRIPTION OF PREFERRED EMBODIMENTS AND METHODS

Figure 1:
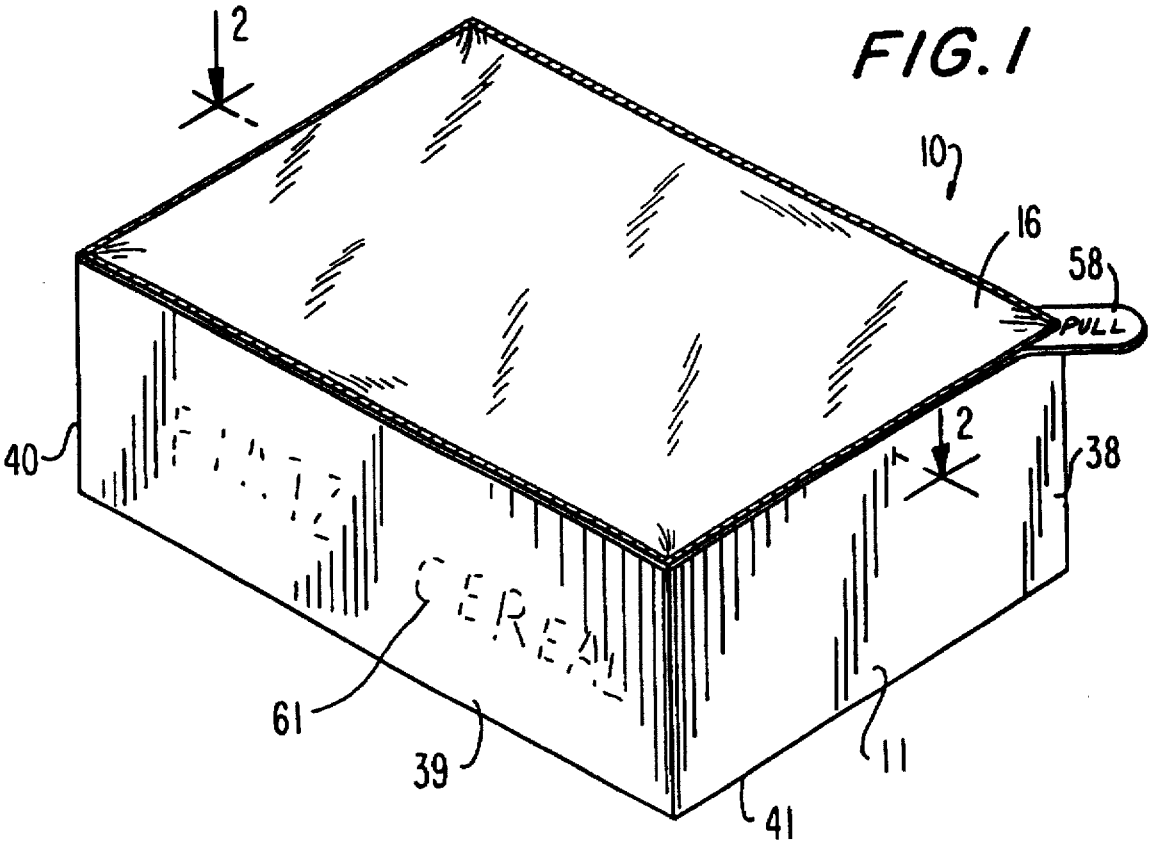
FIG. 1 is a perspective view of a first embodiment of the container of the present invention.
Figure 4:
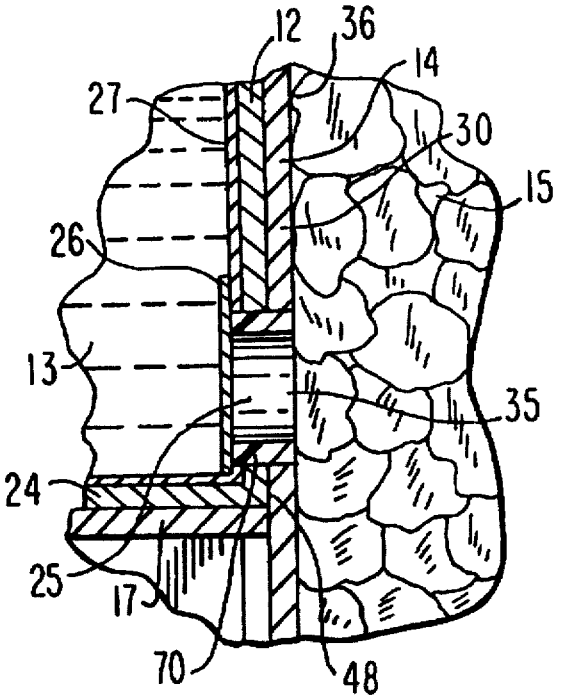
FIG. 4 is an enlarged fragmentary sectional view taken along line 4—4 of FIG. 2.
Figure 2:
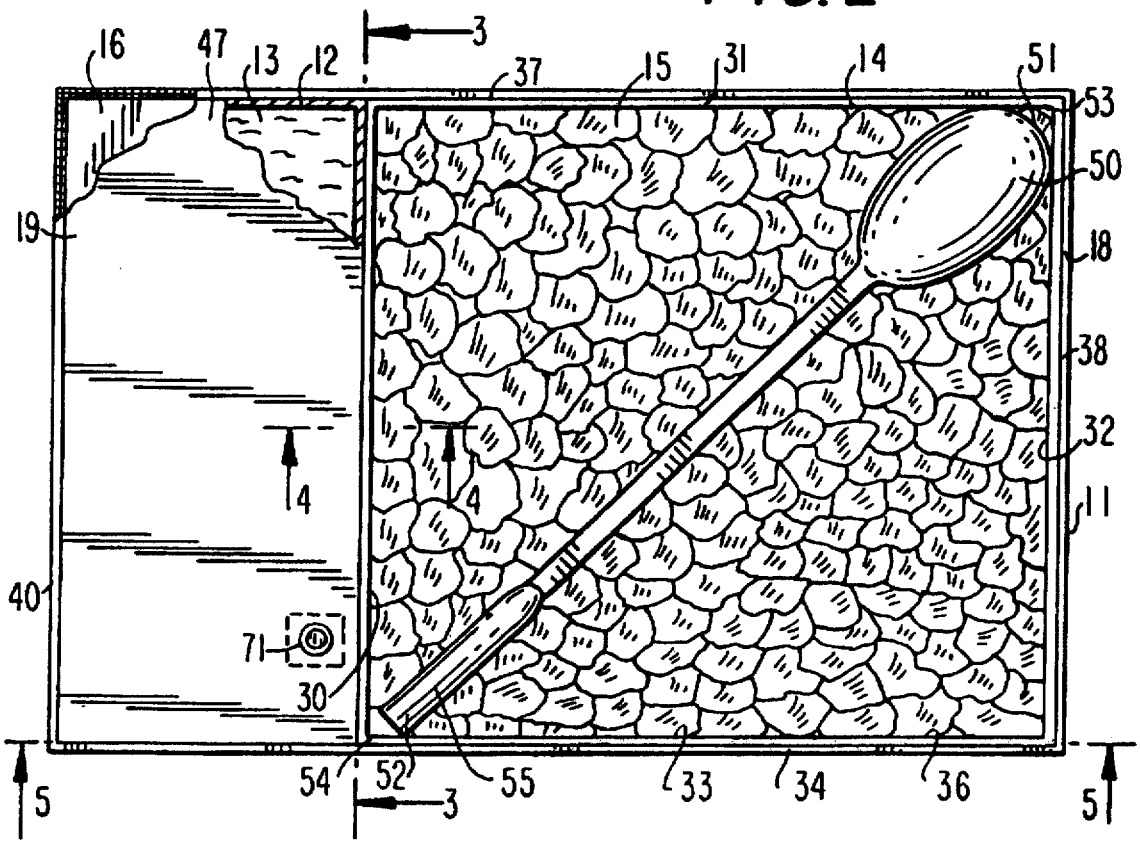
FIG. 2 is an enlarged sectional and partial fragmentary view taken along line 2—2 of FIG. 1.
Figure 3:
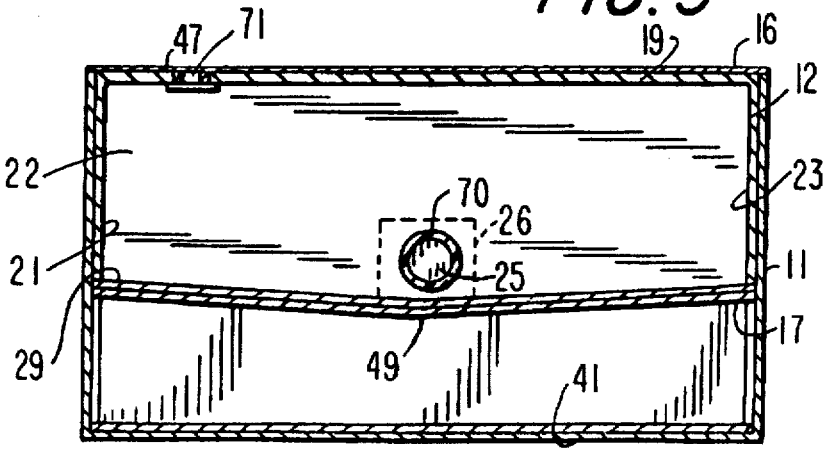
FIG. 3 is a sectional view taken along line 3—3 of FIG. 2.
Figure 5:
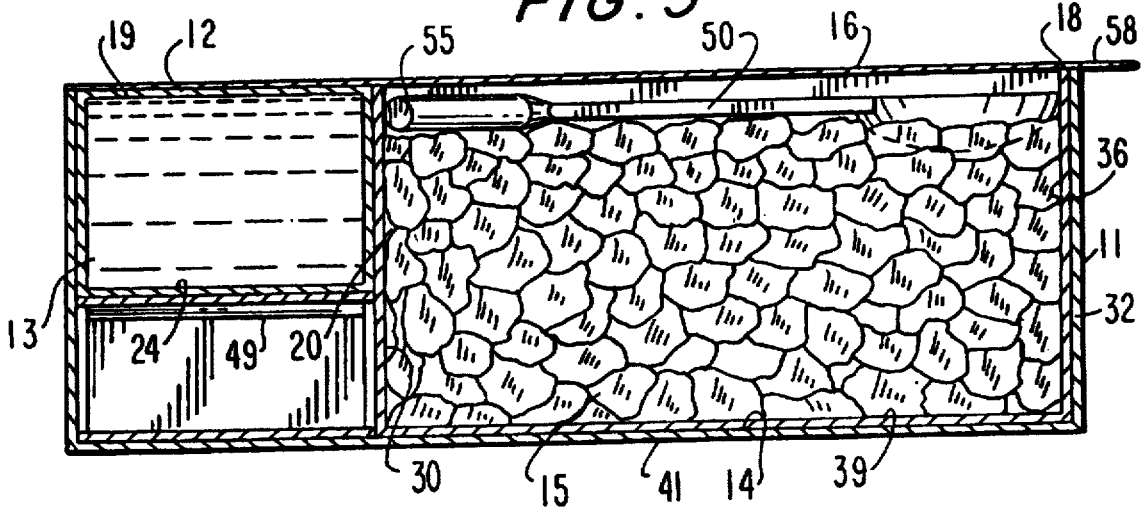
FIG. 5 is a sectional view taken along line 5—5 of FIG. 2.
Figure 6:
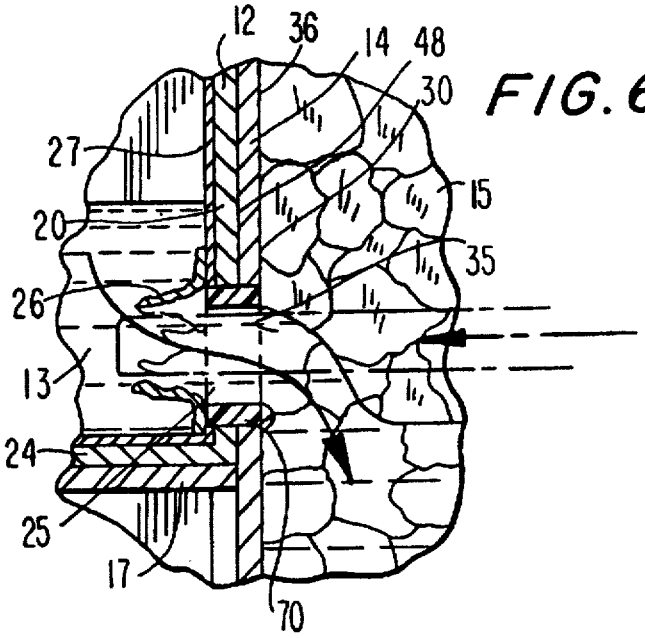
FIG. 6 is a fragmentary view as in FIG. 4 but showing the container in operation.

Referring to FIGS. 1–6 there is showing a container 10 in accordance with an embodiment of the present invention.

Container 10 is formed of a paperboard box or cover 11 holding a first paperboard container 12 for aseptically storing a measured amount of milk or other liquid 13, a second paperboard container 14 for holding a measured supply of cereal or other dry food 15, and a plastic or metallized plastic foil top 16 adhesively sealed to the top edges 18 of box 11 to provide an air-tight seal to preserve the cereal in container 14. A paperboard spacer 17 is preferably provided on which container 12 is supported adjacent container 14. Box 11 maintains container 12, container 14 and sleeve 17 in their relative positions within the unit. Container 12 may additionally be sealed or bonded to container 14 to maintain contact, for reasons hereinafter appearing.

Container 12 of the embodiment is formed in a generally rectangular parallelepiped configuration and has a top 19, sides 20, 21, 22, and 23, and bottom 24. Side 20 is formed with a recessed aperture 25, disposed adjacent bottom 24. A valve 28 is formed of frangible metallized plastic or thermoplastic membrane 26 which overlaps aperture 25 and is integrally bonded to inside laminate layer 27 of container 12 to maintain the aseptic seal, and a tubular plastic member 70. Member 70 is bonded to foil membrane 26, and the walls or sides 20 and 30 to provide an integral construction. Alternately, membrane 26 may be a continuation of the foil barrier contained within the aseptic packaging. The valve 28 for the aseptic package construction may be constructed as shown and described in U.S. Pat. No. 5,303,838. Bottom 24 is provided with a slight central fold to form a depression or trough 49, for purposes hereinafter appearing. Container 12 is preferably of paperboard and thermoplastic or foil laminate construction for the aseptic storage of milk, such is shown and described in U.S. Pat. No. 4,287,247 and U.S. Pat. No. 4,789,066.

Container 14 is formed of paperboard in a generally rectangular parallelepiped configuration having sides 30, 31, 32, 33, and bottom 34. Side 30 and member 70 form aperture 35 which is coincidentally disposed to aperture 25 of container 12 for purposes hereafter appearing. As previously mentioned, an adhesive or thermoplastic bond 48 may be employed to seal or bond side 20 of container 12 to side 30 of container 14. This seal or bond surrounds member 70 and maintains the integral construction. The paperboard of container 14 may be thermoplastically lined or coated 36 on the inside of container 14. A measured amount of dry breakfast cereal or other dry food 15, is contained at the bottom of container 14. Liner 36 protects the stay-fresh condition of the cereal, and the liner 36 helps contain the milk and cereal within container 14.

A second valve 71, similar in construction to valve 28, is disposed in the top 19 of container 12. Valve 71 may, after removal of top 16, be punctured with the end of straw in the well known manner. Valve 71 may be opened prior to opening valve 28 so that the user may drink some of the milk prior to adding the remainder to the cereal. Valve 71 also serves as an air relief to provide the even flow of milk from valve 28. It is to be born in mind that the invention is operable without valve 71, and the inclusion of valve 71 is an alternate embodiment.

Box 11 is of paperboard construction and is of rectangular parallelepiped configuration having sides 37, 38, 39, 40 and bottom 41. The cardboard folded sleeve 17 is positioned in box 11. Container 12 is supportable mounted on sleeve 17. Containers 12 and 14 and sleeve 17 are fictionally held and secured within box 11. The foil top piece 16 is releasably adhesively bonded to contiguous top edge 18 of the sides of container 14, by means well known in the packaging art. Foil piece 16 is provided with lift or pull tab 58. The rectangular parallelepiped folded paperboard construction of units 12, 14, 17 and 11 are well known, and such boxes or containers are readily constructed by those skilled in the box making art.

A molded thermoplastic spoon 50 is sized and contoured to be removably positioned at its ends 51 and 52 in respective corners 53 and 54 of container 14. Spoon 50 is formed with a cylindrical end portion 55 which is sized to be slidable within holes 25 and 35, for reasons hereinafter.

By means of the aforesaid construction, cereal 15 is sealed in container 14, with spoon 50 disposed on the cereal and at the corners of container 14. A measured supply of whole or unprocessed milk 13 is aseptically packaged in container 12.

In operation, the user lifts pull tab 58 of foil piece 16 to break the seal and pulls or removes the foil piece 16. In this manner, the user then pushes end portion 55 of spoon 50 through member 70 and apertures 35 and 25 to break foil piece 26. With removal of the spoon end 55, the milk 13 gravity flows from container 12 through member 70 and apertures 35 and 25 into container 14 and onto cereal 15. Fold 49 at the bottom 24 of container 12 ensures that essentially all the milk gravity flows out of container 12.

It is important to note that the frangible foil membrane 26 is recessed in holes 35 and 25 so that it cannot be inadvertently damaged or broken, and may only be broken once the user opens container 14 and then purposefully inserts the specially designed end 55 of spoon 50.

The box 11, containers 12 and 14, and spacer 17 provide an integral unit that may be stacked and stored on supermarket shelves or stored easily in an aircraft galley. Box side 39, may also by way of example, provides product display information 61.

The box 11, containers 12 and 14 and platform 17 may be of plastic, paperboard or fiberboard construction or like conventional construction, and may be coated and/or impregnated with thermoplastics or waxes, so as to provide semi-rigid, protective packaging.

After the user consumes the cereal and milk, the container may be readily ecologically disposed in receptacles designed for waste plastic and paperboard.

It is within the broad contemplation of this invention to provide for all known, forms of milk, such as by way of example, whole, skimmed, low-fat, and the like, and all forms of cereal, such as by way of example, flakes, puffs, granules, or oatmeal and the like. It is also within the broad contemplation of the invention that any liquid and liquid combinable material may be stored and used in the invention.

The frangible foil construction may be as shown and described in U.S. Pat. No. 5,303,838 and U.S. Pat. No. 4,789,066, as is well known in the art. The valve may be a specially designed aseptic aperture seal which is first molded and constructed and then thermoplastically bonded to the aseptic container, as is shown and described in U.S. Pat. No. 5,303,838.

Figure 7:
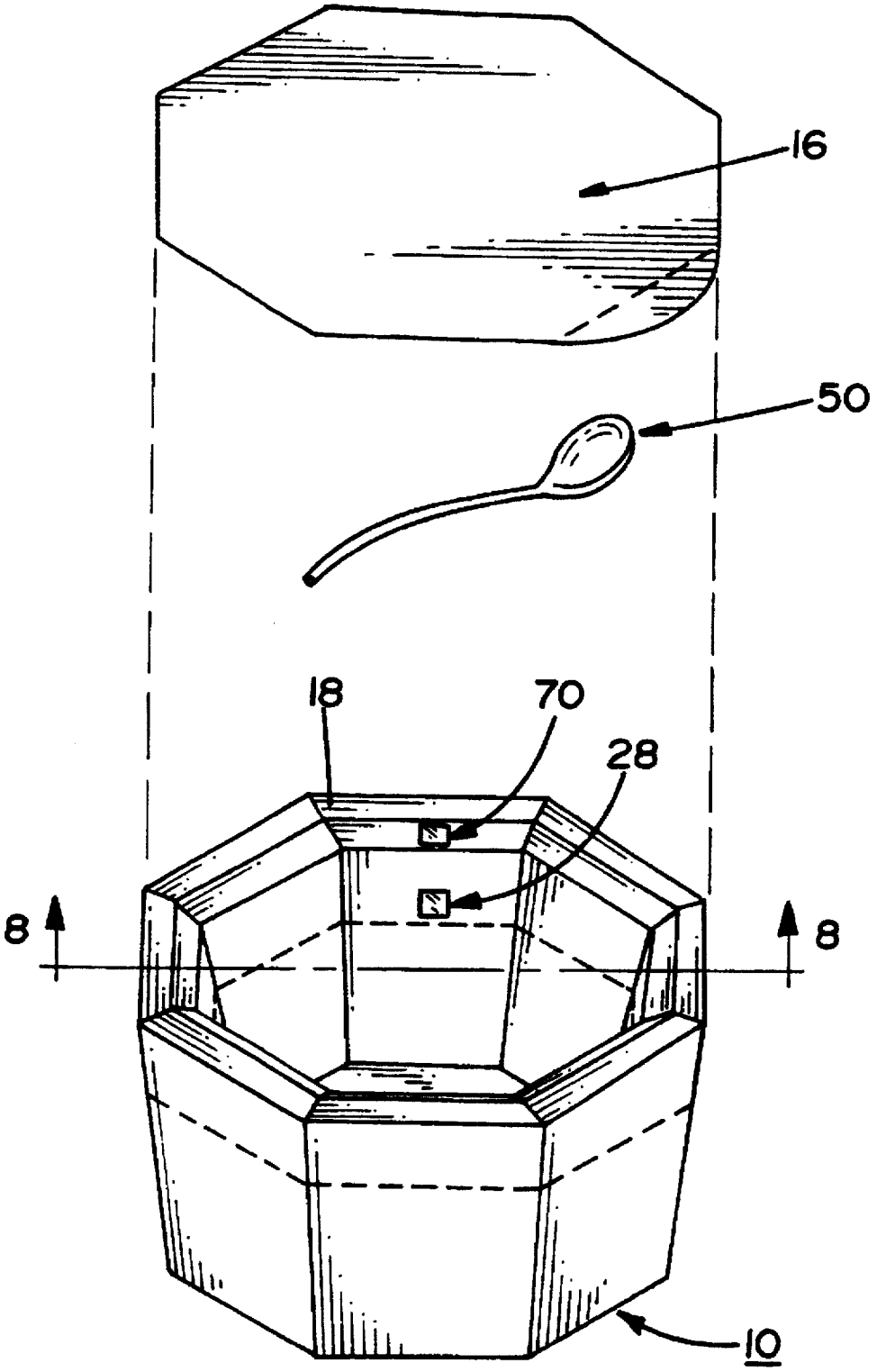
FIG. 7 is a perspective view of a second embodiment of the container of the present invention.
Figure 8:
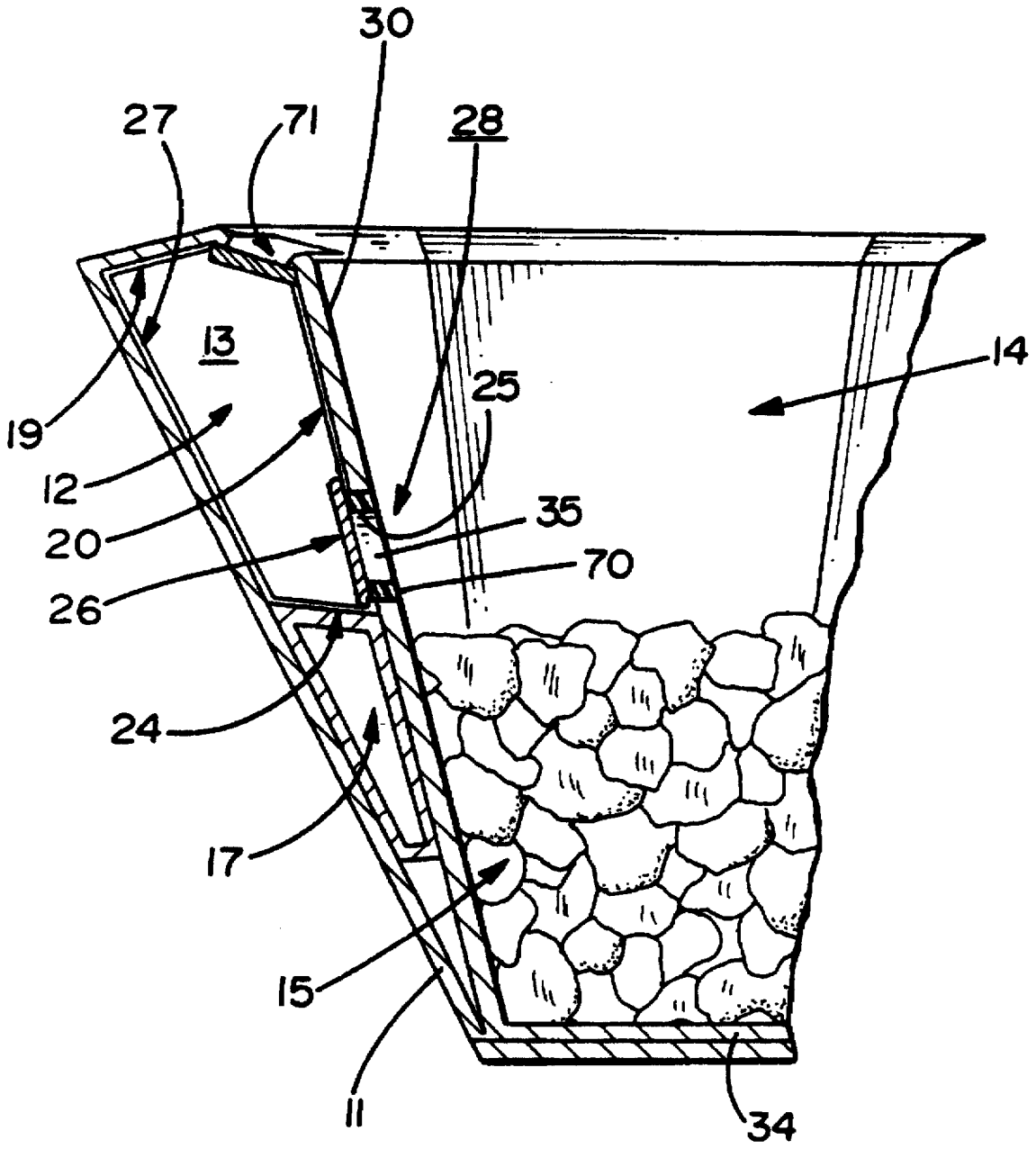
FIG. 8 is an enlarged sectional and partial fragmentary view taken along line 8—8 of FIG. 7.

FIGS. 7–8 show a second embodiment of the present invention. Similar elements of the embodiment of FIGS. 7–8 are similarly numbered to the elements of the embodiment discussed with reference to FIGS. 1–6. Container 10 comprises a cereal container 14 for holding a serving of cereal or other dry food 15, a liquid container 12 aseptically housing a single serving of milk or other liquid 13 and preferably a laminated paperboard, metal foil, plastic, or metallized plastic liquid top 16 adhesively sealed to the top edge 18 of container 10 to provide an air-tight seal to preserve the cereal in container 14. Cereal container 14 comprises side wall 30 and bottom wall 34 and is preferably substantially bowl shaped, e.g a circular, octagonal, hexagonal outline defining a depression of sufficient capacity to contain an appropriate serving of cereal, but may also be of rectangular parallelepiped configuration. Liquid container 12 comprises top 19, inner and outer side walls 20 and 21, respectively, and bottom 24 and is disposed around the periphery of cereal container 14. Preferably, inner side wall 20 is sealed or bonded to side wall 30 of cereal container 14 to form a substantially annular reservoir for containing aseptic milk or other liquid 13 therein. A spacer 17 may be used to support bottom 24 of liquid container 12 above bottom wall 34 of cereal container 14 or, preferably, the tapered shape of box 11 alone or in cooperation with the adhesive bond between walls 20 and 30 maintains liquid container 12 in the appropriate position.

As with the embodiment of FIGS. 1–6, container 14 is preferably of paperboard construction, but may also be thermoplastic. Similarly container 12 is preferably of laminated paperboard construction, but may also be thermoplastic. Side 20 is formed with an aperture 25 disposed adjacent bottom 24 of liquid container 12. A valve 28 of similar construction to the valve of the FIGS. 1–6 embodiment passes through walls 20 and 30 to provide a path for liquid to flow from the liquid container 12 through aperture 35 in wall 30 to the cereal container 14. Bottom 24 of liquid container 12 is inclined toward the center of cereal container 14 to promote complete emptying of container 12 through the valve once opened. The embodiment of FIGS. 8–9 may include the second valve 71 and spoon 50 of the FIGS. 1–6 embodiment.

Figure 9:
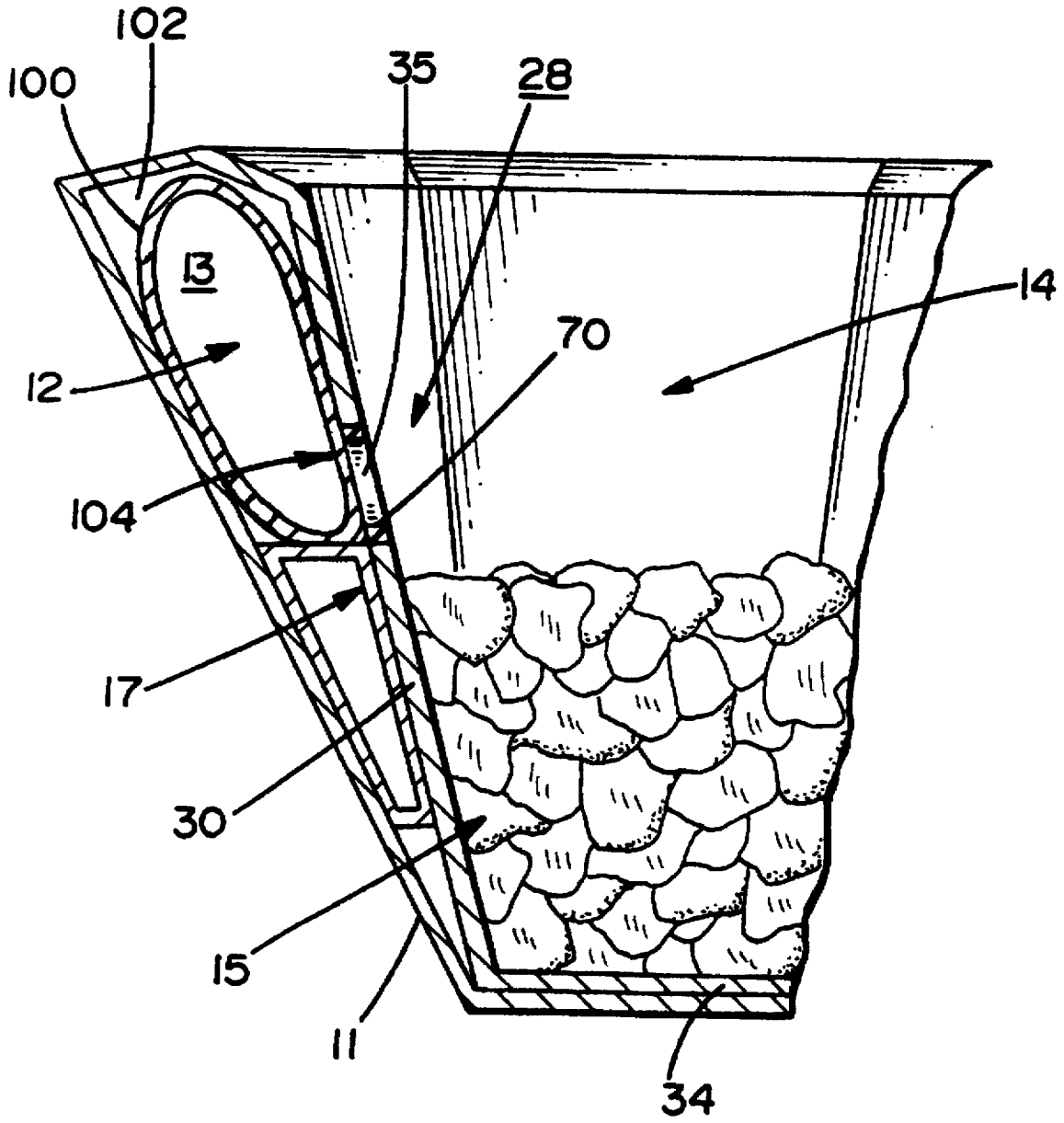
FIG. 9 is an enlarged sectional and partial fragmentary view of a third embodiment of the present invention incorporating a flexible membrane liquid container.

FIG. 9 shows an alternate embodiment of the present invention in which the liquid container 12 comprises a flexible membrane 100 contained within a non-aseptic compartment 102 formed by the outer wall 30 of cereal container 30, spacer 17, and a portion of the outer wall of box 11. Membrane 100 is of preferably formed of metal foil or metallized thermoplastic film as is common in the art for similar purposes, such as for collapsible aseptic fruit juice containers and the like. Lower inner surface 104 of membrane 100 is adhesively sealed to outer wall 30 of cereal container 14. Aperture 35 with tubular member 70 is formed in side 30 and is disposed coincidentally with scaled lower inner surface 104 of membrane 100 to expose a portion of membrane 100 to aperture 35. In operation, the user pierces membrane 100 through aperture 35 to begin the flow of liquid. The liquid flows freely without an air relief valve as the membrane 100 collapses. Alternately, a valve assembly similar to the valve assembly 28 of the FIGS. 1–6 embodiment may be substituted in place of piercing the membrane directly.

Figure 10:
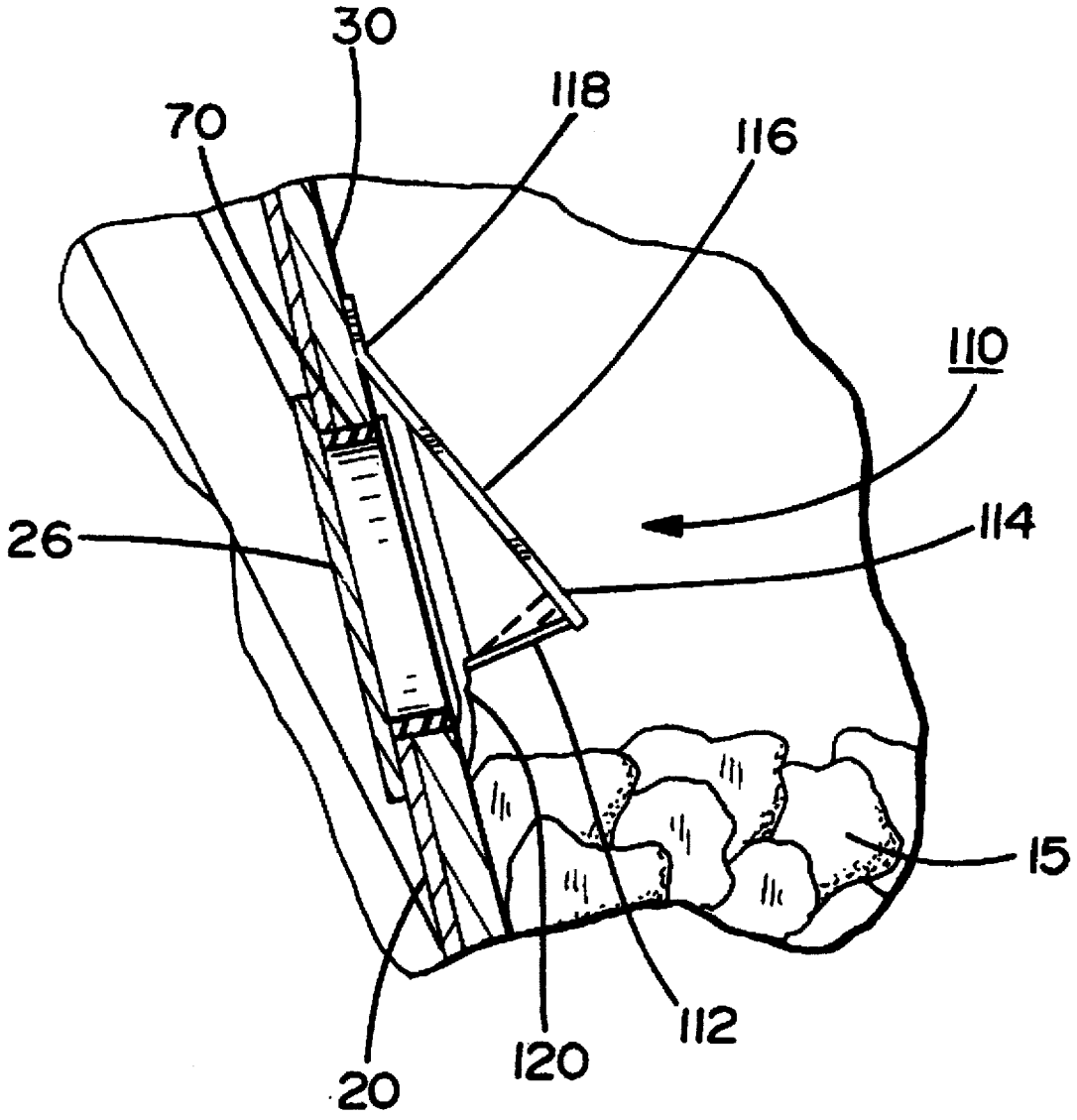
FIG. 10 is a side view of a valve opener according to an embodiment of the present invention.

FIG. 10 shows a side view of an alternative opener embodiment for puncturing the valve 28. The opener 110 comprises a cutting blade 112 fixed to the free end 114 of actuator 116, which may be a generally flat thermoplastic tab. The opposite end of actuator 116 is bonded to side wall 30 and is provided with an undercut to form a hinge 118 between actuator 116 and side wall 30. An undercut, breakaway tab 120 is provided to hold the cutting blade 112 juxtaposed to the foil membrane 26. Alternately, hinge 118 may be biased to urge blade 112 away from foil membrane 26 and thereby maintain the juxtaposed configuration. In operation, the user presses on the actuator 116 to push the cutting blade 112 through the membrane 26. Opener 110 may be suitably decorated to assist young persons in learning to use the opener.

Figure 11:
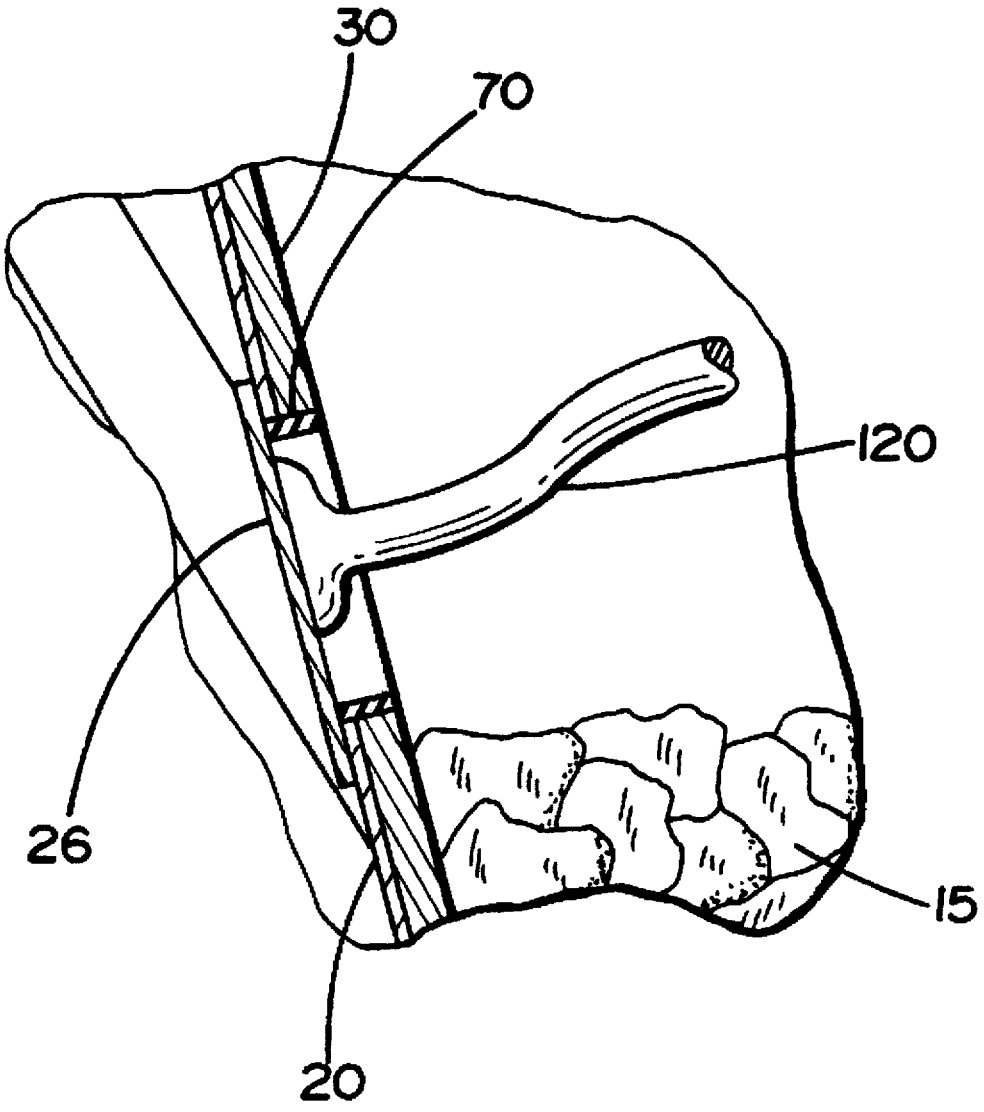
FIG. 11 is a side view of an alternative opener according to an embodiment of the present invention.

FIG. 11 shows an additional embodiment in which foil membrane 26 is automatically ruptured upon removal of the package foil top 16 is removed. According to this embodiment, filament 120 is bonded to membrane 26 and bonded to the underside of foil top 16 as it is bonded to package 10. When the user lifts foil top 16, filament 120 tears away a substantial section of foil membrane 26.

Although certain preferred embodiments and methods have been disclosed herein, it will be apparent from the foregoing disclosure to those skilled in the art that variations and modifications of such embodiments and methods may be made without departing from the true spirit and scope of the invention. Accordingly, it is intended that the invention shall be limited only to the extent required by the appended claims and the rules and principles of applicable law.

What is claimed is:

1. A single use dry food and liquid container comprising:

a liquid container capable of aseptically storing liquid, said liquid container comprising rigid first and second side walls, a rigid top wall, and a rigid bottom wall;

a dry food container capable of storing dry food product, said dry food container having a side wall integral to said first side wall of said liquid container, thereby forming a substantially common wall between said dry food container and said liquid container, said dry food container further having a bottom wall displaced downward from said bottom wall of said liquid container, said dry food container further including a removable lid for hermetically sealing said dry food container;

an aperture, said aperture passing through said common wall adjacent the bottom wall of said liquid container; and a destructible membrane aseptically sealing said aperture, said destructible membrane being sized and constructed to resist rupturing except by direct manipulation, and being accessible for rupturing by a user from within said dry food container;

whereby said removable lid of said dry food container may be removed to open said dry food container and to expose said destructible membrane for rupturing, whereupon said destructible membrane may be ruptured to allow gravity flow of liquid from said liquid container through said aperture into said dry food container, and whereby the rupturing of said destructible membrane renders the container unsuitable for reuse.

2. The container of claim 1 wherein said liquid container is adjacent said dry food container.

3. The container of claim 2 wherein said liquid container further includes a second aperture, said second aperture having a destructible membrane aseptically sealing said second aperture, whereby said second membrane is capable of being ruptured to admit air into said liquid container for displacing said liquid as it flows out of said liquid container through said first aperture.

4. The container of claim 1 wherein said liquid container substantially surrounds said dry food container.

5. The container of claim 1 wherein said liquid container further includes a second aperture, said second aperture also having a destructible membrane aseptically sealing said second aperture, whereby said second membrane is capable of being ruptured to admit air into said liquid container for displacing said liquid as it flows out of said liquid container through said first aperture.

6. The container of claim 1, wherein said destructible membrane is capable of being punctured with a hand instrument.

7. The container of claim 1, wherein said removable lid further includes an inside surface, and further including a lanyard having a first end fixed to said inside surface of said lid and a second end permanently attached to said destructible membrane, whereby said destructible membrane is ruptured by said lid being removed and said lanyard pulled to tear away said attached portion of said rupturable membrane.

8. The container of claim 1, further including a piercing valve attached to said common wall adjacent said destructible membrane, said piercing valve comprising a blade having a hinged end and a free end, said hinged end being fixed to said common wall and said free end held by said hinged end juxtaposed said destructible membrane.

9. The container of claim 8, further including a lanyard having a first end fixed to said inside surface and a second end fixed to said piercing valve, whereby said destructible membrane is ruptured as said lid is removed and said lanyard is pulled to actuate said piercing valve.

10. The container of claim 1, wherein said removable lid is a film bonded to said dry food container.

11. The container of claim 1 wherein said removable lid is a tear-away paperboard wall of said dry food container.

12. A single use dry food and liquid container comprising:

a dry food container capable of storing a dry food product, said dry food container comprising a first side wall, a bottom wall, and a removable lid for hermetically sealing said dry food container;

a liquid container compartment comprising rigid first and second side walls and a bottom wall, said bottom wall of said liquid container compartment being displaced above said bottom wall of said dry food container;

a liquid container within said liquid container compartment, said liquid container comprising a flexible enclosure capable of aseptically storing liquid and having a surface sealed to said first side wall of said dry food container to form a substantially integral wall between said dry food container and said liquid container;

an aperture, said aperture passing through said substantially integral wall adjacent the bottom wall of said liquid container compartment; and a destructible membrane aseptically sealing said liquid container from said aperture, said destructible membrane being sized and constructed to resist rupturing except by direct manipulation, and being accessible for rupturing by a user from within said dry food container;

whereby said removable lid of said dry food container may be removed to open said dry food container and to expose said destructible membrane, whereupon said destructible membrane may be ruptured to allow gravity flow of liquid from said liquid container through said aperture into said dry food container, and whereby the rupturing of said destructible membrane renders the container unsuitable for reuse.

13. The container of claim 12 wherein said liquid container is adjacent said dry food container.

14. The container of claim 12 wherein said dry food container is bowl-shaped and said liquid container comprises a substantially annular container surrounding said dry food container.

15. A single use dry food and liquid container comprising:

a liquid container capable of hermetically storing liquid, said liquid container comprising rigid first and second side walls, a top wall, and a bottom wall;

a dry food container capable of storing dry food product, said dry food container having a side wall integral to said first side wall of said liquid container, thereby forming a substantially common wall between said dry food container and said liquid container, said dry food container further having a bottom wall displaced downward from said bottom wall of said liquid container, said dry food container further including a removable lid for hermetically sealing said dry food container;

an aperture, said aperture passing through said common wall adjacent the bottom wall of said liquid container; and a destructible membrane hermetically sealing said aperture, said destructible membrane being sized and constructed to resist rupturing except by direct manipulation, and being accessible for rupturing by a user from within said dry food container;

whereby said removable lid of said dry food container may be removed to open said dry food container and to expose said destructible membrane for rupturing, whereupon said destructible membrane may be ruptured to allow gravity flow of liquid from said liquid container through said aperture into said dry food container, and whereby the rupturing of said destructible membrane renders the container unsuitable for reuse.

16. The container of claim 15 wherein said liquid container is adjacent said dry food container.

17. The container of claim 15 wherein said dry food container is bowl-shaped and said liquid container comprises a substantially annular container surrounding said dry food container.

18. The container of claim 15 wherein said liquid container further includes a second aperture, said second aperture also having a destructible membrane aseptically sealing said second aperture, whereby said second membrane may be ruptured to admit air into said liquid container for displacing said liquid as it flows out of said liquid container through said first aperture.

19. The container of claim 15, further including a piercing valve attached to said common wall adjacent said destructible membrane, said piercing valve comprising a blade having a hinged end and a free end, said hinged end being fixed to said common wall and said free end held by said hinged end juxtaposed said destructible membrane.

* * * * *